US006742461B1

(12) United States Patent
Sen

(10) Patent No.: US 6,742,461 B1
(45) Date of Patent: Jun. 1, 2004

(54) EXTENSIBLE TABLE

(75) Inventor: Lor Lean Sen, Prai (MY)

(73) Assignee: Green Continental Furniture (M) SDN BMD, Kedah (MY)

( * ) Notice: Subject to any disclaimer, the term of this patent is extended or adjusted under 35 U.S.C. 154(b) by 37 days.

(21) Appl. No.: 10/194,503

(22) Filed: Jul. 12, 2002

(30) Foreign Application Priority Data

Jul. 13, 2001 (MY) ..... PI 20013344

(51) Int. Cl.[7] ..... A47B 1/00
(52) U.S. Cl. ..... 108/86
(58) Field of Search ..... 108/85, 86, 84, 108/87

(56) References Cited

U.S. PATENT DOCUMENTS

| | | | | | |
|---|---|---|---|---|---|
| 136,243 | A | * | 2/1873 | Herzog | 108/84 |
| 580,543 | A | * | 4/1897 | Bradford | 108/85 |
| 945,955 | A | * | 1/1910 | Johnson | 108/84 |
| 1,270,458 | A | * | 6/1918 | Syred | 108/85 |
| 1,358,353 | A | * | 11/1920 | Zimmer | 108/67 |
| 1,464,409 | A | | 8/1923 | Cooklin | |
| 1,861,565 | A | * | 6/1932 | Hall | 108/84 |
| 2,050,561 | A | * | 8/1936 | Crosno | 108/84 |
| 2,106,422 | A | * | 1/1938 | Dahl | 108/69 |
| 2,240,551 | A | * | 5/1941 | Cooper | 108/86 |
| 4,061,091 | A | * | 12/1977 | Goyvaerts | 108/84 |
| 4,077,335 | A | | 3/1978 | Luzzani et al. | |
| 4,297,952 | A | | 11/1981 | Zagaroli | |
| 4,344,369 | A | * | 8/1982 | Van Noord | 108/84 |
| 4,494,466 | A | * | 1/1985 | Synek et al. | 108/85 |
| 4,718,354 | A | | 1/1988 | Piretti | |

FOREIGN PATENT DOCUMENTS

| | | |
|---|---|---|
| DE | 3119606 | * 12/1982 |
| DE | 3416391 | * 11/1985 |
| FR | 2578729 | * 3/1986 |

* cited by examiner

*Primary Examiner*—Jose V. Chen
(74) *Attorney, Agent, or Firm*—Wiggin and Dana LLP; Elizabeth A. Geschke; Gregory S. Rosenblatt

(57) ABSTRACT

An extensible table with its unextended tabletop formed by leaves that are slidably fixed on the supporting frame of the table. The sliding leaves are moved away from each other to reveal a hidden extension leaf that is raised by momentarily applying an initiating downward force. The extension leaf raises itself to the same level as the sliding leaves are to form an extended tabletop. The extension leaf is moved down to its original level by an applied downward force and allows for the sliding leaves to be slid toward each other to form the unextended tabletop. Latching is accomplished by a latching pin. The first end of the latching pin is in a pin housing. This allows the second end of the latching pin to move in the groove of the grooved block. A spring in the pin housing holds the second end of the pin in the grove.

1 Claim, 5 Drawing Sheets

EXTENSIBLE TABLE

CROSS-REFERENCE TO RELATED APPLICATION

This patent application claims priority of Malaysian Patent Application PI 20013344 entitled "Extensible Table" that was filed on 13 Jul. 2001, the disclosure of which is incorporated by reference in its entirety herein.

BACKGROUND OF THE INVENTION

1. Field of the Invention

This invention relates to an extensible table that has sliding leaves, an extension leaf and a mechanism for the extension leaf to be raised and lowered vertically after the sliding leaves are moved away from each other to reveal the extension leaf.

2. Description of the Related Art

Among the many extensible tables available, some employ sliding movement to extend the tabletop. An example of an extensible table with slidable leaves is demonstrated in U.S. Pat. No. 4,297,952. This table has two leaves that can be slid away from each other for a separate third leaf to be placed in the middle of the table to form a extended tabletop. The third leaf however is detachably fixed to the table and can be easily lost. U.S. Pat. No. 4,077,335 shows a tabletop extended to twice its original length by fully sliding out two leaves from a stacked position to a side-by-side position. U.S. Pat. No. 4,718,354 shows a tabletop that is made of a flexible covering sheet with both ends being passed underneath its working plane. The flexible covering sheet is attached to a rigid panel that forms the working plane. When the table is to be extended, the ends of the table are pulled away from each other along the length of the table.

BRIEF SUMMARY OF THE INVENTION

An extensible table that is extended by sliding two sliding leaves away from each other to reveal the extension leaf. The extension leaf is raised to the same level as the sliding leaves by applying an initial downward force. When the initial force is removed, the table rises by means of a raising mechanism. It is lowered by applying downward force to move the extension leaf back to its original lower level.

All the leaves are advantageously supported on a supporting frame which in turn is supported by vertical supporting members each with one end attached to the supporting frame and the other atop a horizontal floor plane. The mechanism for raising and lowering the extension leaf advantageously includes spring-loaded shafts loaded with spring and a latching means. The shafts are advantageously, attached to the supporting frame and the bottom of the extension leaf and provide the support needed and the upward force for raising the extension leaf. The latching means advantageously includes a latching pin which has one end housed in a pin housing. The pin housing is advantageously attached to the bottom of the extension leaf. The other end of the latching pin is advantageously always in the groove of a grooved block located opposite the pin housing and attached to the supporting frame. This may be achieved by having a spring in the pin housing to provide the force to hold the other end of the latching pin in the groove. The pin is advantageously bent into shape and snugly fitted in a cylindrical hollow of the pin housing. In this manner, the end of the latching pin in the said groove may advantageously move freely in the groove with respect to the end of the pin in the pin housing. The groove advantageously has a closed loop groove track with sections of varying depth. These sections may each have a constant groove depth that is different from that of the other sections or may each have varying groove depth as one traces along the entire groove. Such varying depths enable the pin, thus the extension table, to be latched at different levels as the pin moves cyclically in a given direction, clockwise or counter-clockwise.

The details of one or more embodiments of the invention are set forth in the accompanying drawings and the description below. Other features, objects, and advantages of the invention will be apparent from the description and drawings, and from the claims.

DESCRIPTION OF THE DRAWINGS

Like reference numbers and designations in the various drawings indicate like elements.

DETAILED DESCRIPTION

Figure 1:
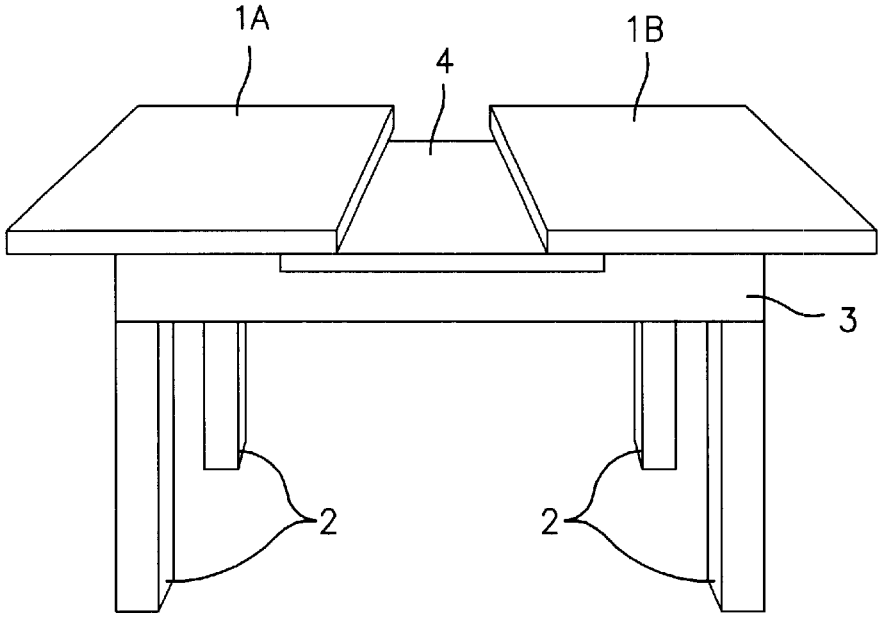
FIG. 1 is a perspective view of an extensible table with sliding leaves partially slid apart from each other to reveal an extension leaf.
Figure 2:
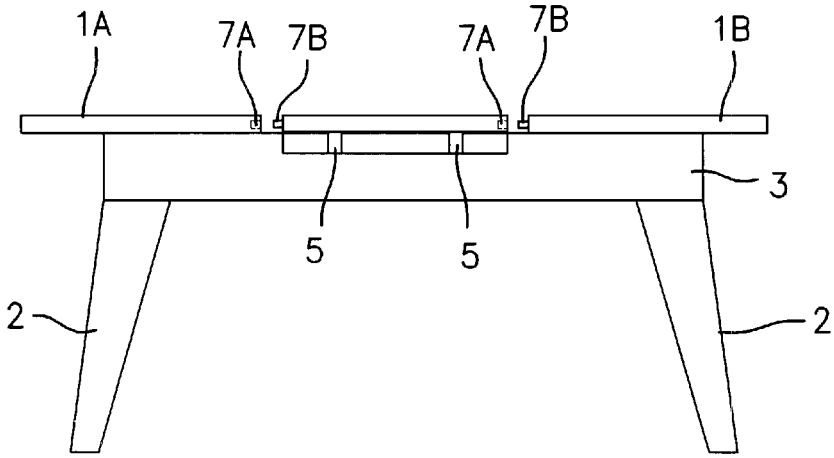
FIG. 2 is a side view of the extensible table of FIG. 1 with the extension leaf raised and supported by shafts located at the corners of the extension leaf.

An extensible table in its unextended form advantageously looks like any conventional table. FIG. 1 shows an extensible table having a rectangular tabletop made up of two sliding leaves 1A, 1B slidably fixed to an apron 3. Supporting members (legs) 2, each of which is attached to a corner of the apron, support the tabletop together with the apron 3. An extension leaf 4 is initially located beneath the sliding leaves 1A, 1B at the center of the apron 3. In order to extend the table, so that the area of the tabletop will increase, the sliding leaves 1A, 1B tabletop are slid apart from each other in opposite directions to the fullest extent allowable by the sliding means. This fully reveals the extension leaf 4 that was previously hidden from sight. Then, a downward force is manually applied to the extension leaf 4 (e.g., by a user's hand(s) pressing downward on the upper surface) so that the extension leaf 4 initially moves down slightly from an initial lower level to a depressed level. The downward force is then removed and the extension leaf is raised by its mechanism (explained below) to the level of both the sliding leaves (FIG. 2). The extension leaves are then pushed toward each order so that the gaps between the sliding leaves and the extension leaf are closed to provide an extended tabletop.

In order to restore the extensible table back to its unextended form, the sliding leaves are slid away from the extension leaf to reopen the gaps. After that, downward force is manually applied to the extension leaf so that it goes from its raised higher level all the way back down to the depressed level. As the downward force is removed, the leaf moves up slightly to the initial lower level but not further because it has been latched at this lower position. The sliding leaves are then slid toward each other so that they join together to reform the tabletop in its unextended form. The extension leaf will be hidden away as the sliding leaves slide toward each other. As shown in FIG. 2, the sides of both the sliding leaves and extension leaf that defines the gaps may have pairs of slots 7A and plugs 7B. The slots and plugs are aligned relative to each other so that the plugs engage the opposing slots when the sliding leaves are pushed into engagement with each other or with the raised extension leaf. The slots and plugs keep the whole extended tabletop intact so that the extension leaf could not be unintentionally lowered when a downward force is applied to it. When the table is unextended, the slots and plugs of the sliding leaves are engaged to each other to keep the sliding leaves firmly together as a functioning tabletop.

Figure 3:
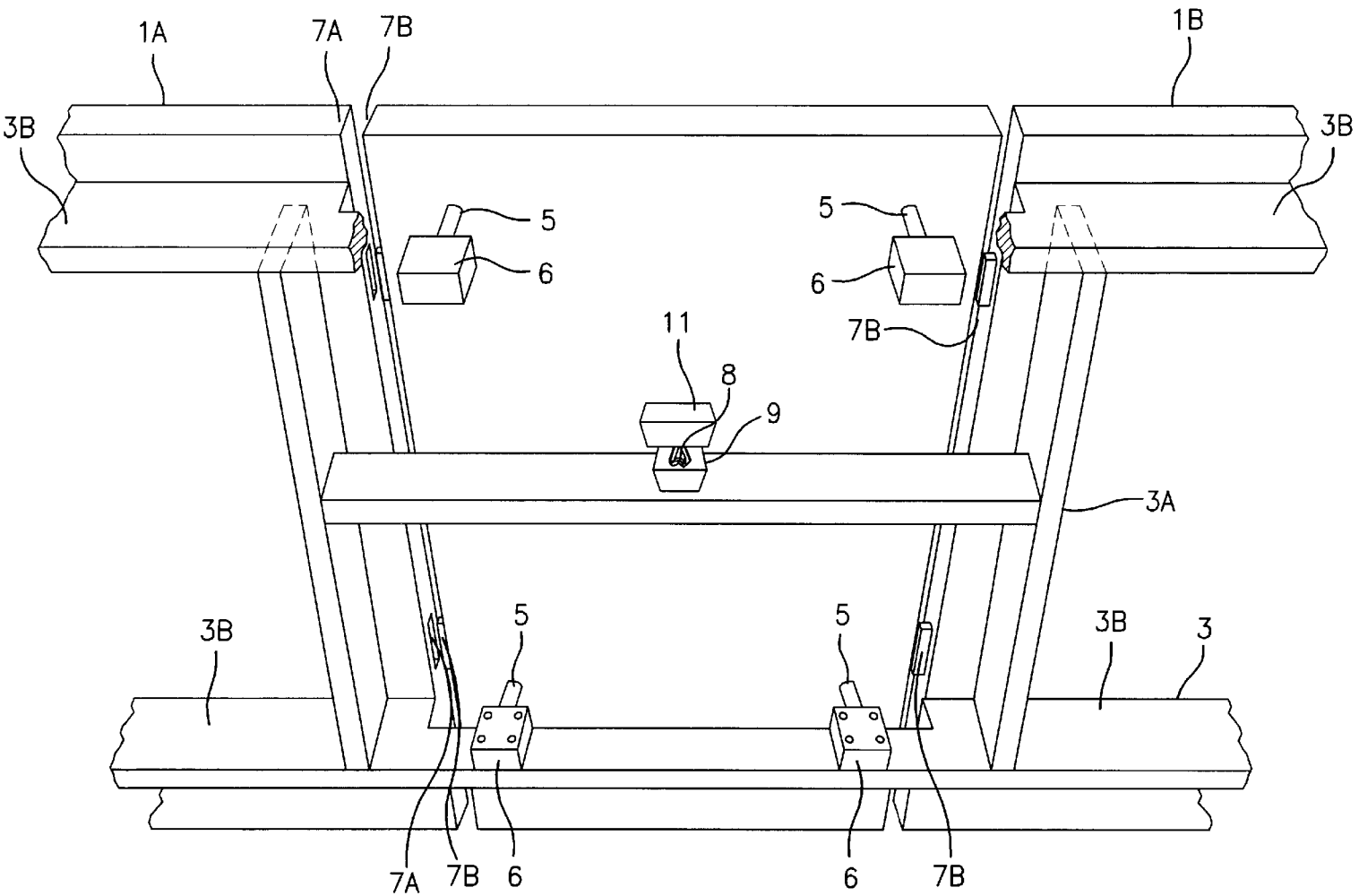
FIG. 3 is perspective view of the bottom of the extensible table of FIG. 1 showing the raised extension leaf.
Figure 4:
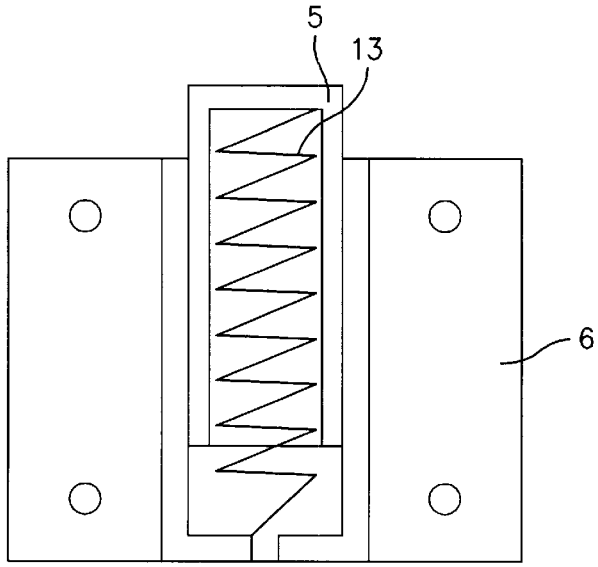
FIG. 4 is a cross sectional view of a spring-loaded support shaft.

The extension leaf is raised to its higher position and lowered to its lower position by a mechanism that advantageously acts independently of the sliding leaves. FIG. 3 shows the extension leaf attached to four shafts 5 that are located at its four corners. The shafts are mounted in respective shaft housings 6, which in turn are fixed to the apron 3. The details of a shaft and its housing are shown in FIG. 4. The shaft 5 has a smaller dimension (e.g., diameter) and fits into its housing 6, which has an inner dimension slightly larger than the shaft's outer dimension. This allows the shaft to vertically slide up and down without much friction and fit snugly into the housing. The shaft 5 is advantageously hollow and loaded with spring 13 to provide an upward bias force.

Figure 7:
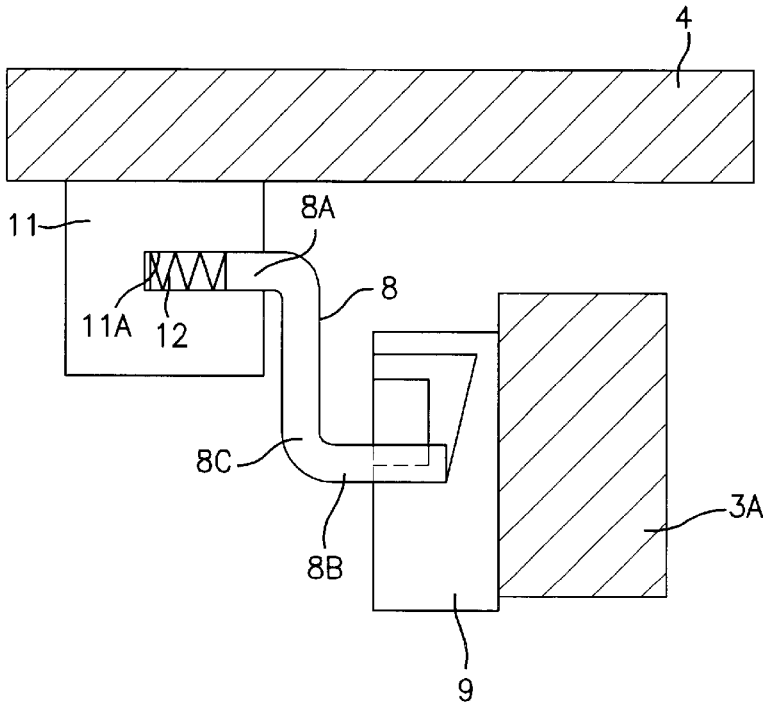
FIG. 7 is a cross-sectional view of the mechanism of FIG. 6 taken along line 7—7.

The extension leaf is latched at its higher and lower positions by means of a latching pin 8, housed in a pin housing 11, working together with a grooved block 9 (FIG. 3). The pin housing is attached to the underside of the extension leaf 4. The latching pin 8 is advantageously formed as a straight rod bent into shape with both of its ends 8A, 8B bent at right angles to a central portion 8C and of unequal lengths (FIG. 7). The latching pin in the illustrated embodiment has its shorter end 8B housed in the pin housing 11 while its longer end rests in the groove 10 of the grooved block 9. A compressed spring 12 in a hollow section 11A (e.g., a cylindrical bore) of the pin housing applies a force to the latching pin 8 to keep end 8B in the groove 10. The latching pin 8 fits snugly in the hollow section so that its end 8B is able to swivel about the axis of the hollow section accordingly when it moves in the groove.

The grooved block 9 is fixed to the middle of the crossbar of an H-like frame 3A (FIG. 3) of the apron. The legs of the H-like frame are the longer sides of a rectangular frame 3B to form the apron. The sliding leaves and extension leaf are thus slidably reciprocally fixed to and vertically reciprocally fixed to the apron respectively. The apron in turn is supported by supporting members (legs) 2 that are placed on the floor or other horizontal support surface.

Figure 12:
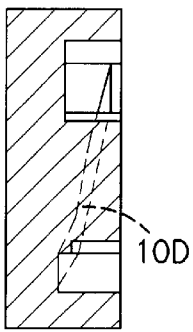
FIG. 12 is a cross-sectional view of the block of FIG. 8 taken along line 12—12.
Figure 11:
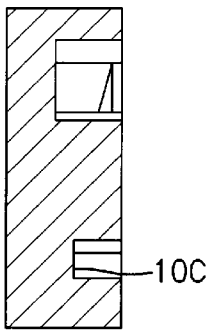
FIG. 11 is a cross-sectional view of the block of FIG. 8 taken along line 11—11.
Figure 8:
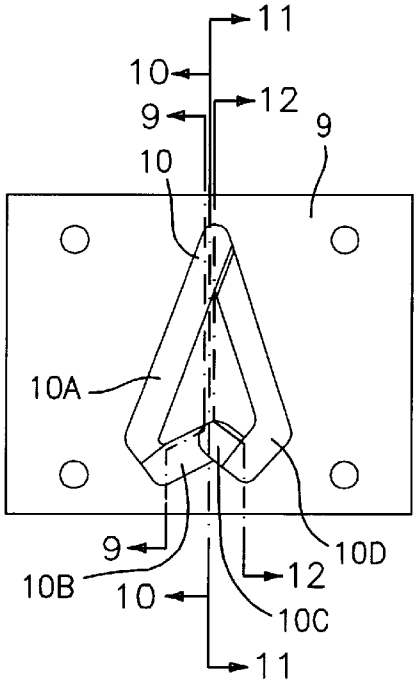
FIG. 8 is a plan view of a grooved block of the mechanism of FIG. 5.
Figure 10:
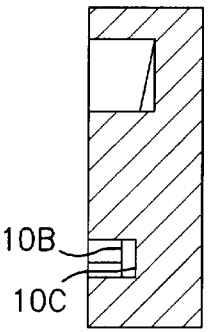
FIG. 10 is a cross-sectional view of the block of FIG. 8 taken along line 10—10.
Figure 9:
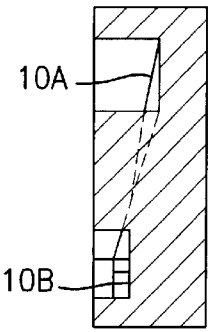
FIG. 9 is a cross-sectional view of the block of FIG. 8 taken along line 9—9.

The grooved block 9 has a closed loop groove 10 (FIG. 8). The groove can be divided into four sections 10A, 10B, 10C, and 10D. FIGS. 9–12 show the depths of the different sections of groove (10A, 10B, 10C, 10D) alternating as one traces along the groove in the anti-clockwise direction. For the sake of description, first end of any section (10A, 10B, 10C, 10D) of groove 10 that is encountered as one traces in that direction is called the beginning end and the last end of that same section is called the last end. In the illustrated embodiment, two sections (10A, 10D) of the groove 10 rise or become shallower as one traces in anti-clockwise direction (FIGS. 8, 9, and 12). Meanwhile, the other two sections (10B, 10C) are level, with 10C is deeper than 10B (FIGS. 8, 10, and 11). 10B is deeper than the shallowest end of 10A (FIGS. 9 and 10), and 10C is shallower than the deepest end of 10D (FIGS. 11 and 12). To complete the loop of the groove (10), the last end of 10D is shallower than the beginning end of 10A (FIGS. 9 and 12) creating an abrupt change in the depth.

The depth of 10A gets shallower as one traces along from the top to the bottom of FIG. 8. The depth of 10B is constant as one traces along from left to right but its depth is deeper than that of the shallowest depth of section 10A. The depth of 10C is also constant but is deeper than that of 10B, which makes it deeper than that of the shallowest depth of 10A. Lastly, the depth of 10D gets shallower as one traces from bottom to the top of FIG. 8. The top of section 10D comes around to meet with the top of section 10A but with an abrupt change of depth from the shallower section 10D to the deeper section 10A. This provides a consistent cycle in the desired direction (anti-clockwise as illustrated)

Figure 5:
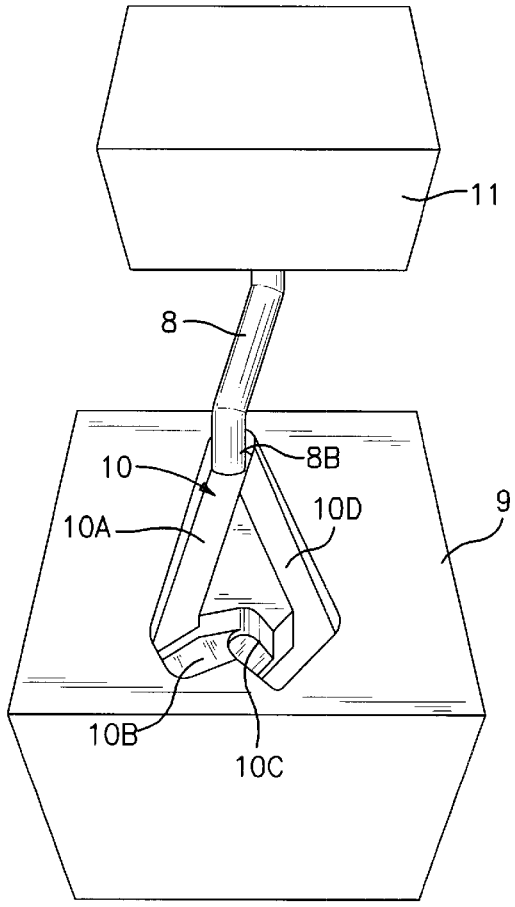
FIG. 5 is a perspective view of a latching mechanism of the table of FIG. 3.
Figure 6:
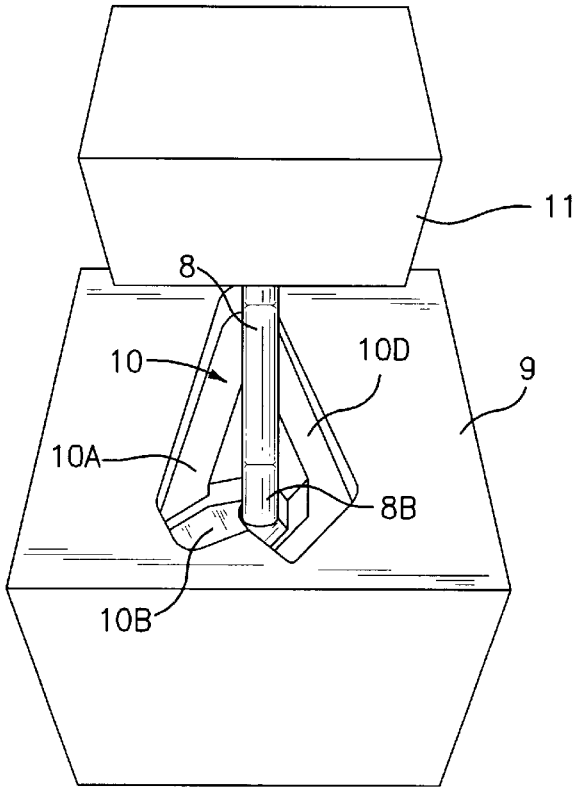
FIG. 6 is a perspective view of the mechanism of FIG. 5 with the extension leaf lowered.

If the table is extended with its extension leaf 4 being at the higher position (FIGS. 3 and 5), the pin 8 (FIG. 5) is slightly swiveled to the left and its shorter end 8B is latched at the top of section 10A. This is due to the upward force applied to extension leaf by the spring-loaded shafts (FIG. 3). When the extension leaf is lowered by applying a downward force to it, the pin housing 11 and the latching pin 8 would move down together with the shorter end 8B of the pin moving along 10A. The shorter end of the pin would not move down along 10D since there is an abrupt change of groove depth as mentioned earlier. The pin would snugly move down along 10A since the diameter of the pin matches the width of the groove 10 and the pin is able to swivel accordingly and is kept in the groove as mentioned earlier. The pin traverses the whole length of 10A and comes to 10B as the downward force is continuously applied to the extension leaf. Since there is an abrupt change of depth from a shallower section to deeper section 10B, the pin 8 is pushed into 10B by its spring 12. At this juncture, the pin has already reached the lowest part of the groove 10, which is the beginning of 10B. The downward force is removed by the user and the said extension leaf rises. Just as the extension leaf rises, the pin moves along 10B since the bottom of 10A is shallower than 10B which prevents the pin from going up along 10A. As the pin moves up along 10B, it swivels accordingly, comes to 10C and stops. The pin now is latched at 10C because the upward force applied by the springs 13 (FIG. 4) loaded in the shafts 5 is not in the direction of 10D (FIG. 6). The extension leaf 4 is now latched at its lower position as depicted in FIG. 1.

In order to raise the extension leaf to its higher level again, a downward force as mentioned earlier is applied again. Referring to FIG. 6, since the pin 8 would go down from 10C to 10D, its end 8B would come to 10D. The compressed spring 12 (FIG. 7) would push the shorter pin end 8B into section 10D whose bottom section is deeper than that of 10C. When the downward force is removed, the pin 8 would go up along 10D due to the mentioned force by the spring loaded shafts 5. The pin is prevented from going up via 10C since 10C is shallower than 10D as mentioned. Therefore, the pin 8 would move along 10D until it comes to the top of 10A again and latches there. The pin 8 would again be pushed into 10A by the compressed spring 12 in the spring housing 11. In this way, the extension leaf 4 is raised again.

A number of variations on this basic system are possible. Movement of the first and second leaves may be synchronized by a synchronizing mechanism. More than one third leaf may be present, each associated with its own raising and lowering and latching mechanisms. In the unextended condition, the first and second leaves may be located below the elevated third leaf which may be lowered after their extension to enter the extended condition.

The embodiments that are mentioned above are merely exemplary of the invention and are not meant to be the only ways for the invention to be implemented. Each part of the embodiments therefore may be varied, modified or adapted by a person skilled in the art without departing form the working principles of the invention which scope is claimed as follows.

What is claimed is:

1. A mechanism for raising and lowering panel to different heights, wherein the panel makes up the whole or part of a tabletop of a table, wherein the said tabletop is supported on supporting frame that is supported by upright supporting members on a horizontal support plane, wherein the said mechanism on its entirety is made up of a least one element comprising:

at least one first raising element having a compressed elastic member and having an upper end attached to a bottom of the panel and a lower end attached to the supporting frame;

a latching means comprising a latching pin, a pin housing and a grooved block, wherein:

the pin housing is attached to the bottom of the panel and the grooved block is attached to the supporting frame;

the latching pin has a first end and a second end and is bent into shape wherein axes of the first and second ends of the latching pin are parallel to each other but do not coincide with each other;

the first end of the latching pin fits in said pin housing, allowing the second end of the said latching pin to swivel about the pin housing;

the pin housing is attached to the bottom of the panel;

the second end of the latching pin is kept in the groove of said grooved block by means of a force applied to the latching pin by a compressed elastic member in the pin housing;

the groove has a closed-loop-shape;

the groove has depth that varies from deep to shallow as the closed-loop is traced along its entire length from a starting point and back to the starting point again; and the second end of the latching pin moves in the groove as the panel moves up and down.

* * * * *